United States Patent [19]

Buckner et al.

[11] Patent Number: 4,493,178

[45] Date of Patent: Jan. 15, 1985

[54] PACKAGING MACHINE

[75] Inventors: Leonard Buckner, Mount Eaton; William A. Foll, Sr., Wooster; Stephen W. Pesho, Dalton, all of Ohio

[73] Assignee: Euclid Spiral Paper Tube Corp., Apple Creek, Ohio

[21] Appl. No.: 525,235

[22] Filed: Aug. 22, 1983

Related U.S. Application Data

[63] Continuation of Ser. No. 242,365, Mar. 10, 1981, abandoned.

[51] Int. Cl.[3] ..... B65B 9/02; B65B 61/26

[52] U.S. Cl. ..... 53/131; 53/555

[58] Field of Search ..... 53/131, 555, 560, 551

[56] References Cited

U.S. PATENT DOCUMENTS

| | | | |
|---|---|---|---|
| 883,690 | 4/1908 | Blythe | 242/76 X |
| 2,286,159 | 6/1942 | Reynolds | 53/131 X |
| 2,549,327 | 9/1951 | Moule | 53/560 X |
| 2,608,405 | 8/1952 | Salfisberg | 53/555 X |
| 3,011,678 | 12/1961 | McClosky | 53/555 X |
| 3,210,903 | 10/1965 | Samberg | 53/555 X |
| 3,245,197 | 4/1966 | Van Mil, Jr. | 53/555 X |
| 3,315,438 | 4/1967 | Kostur, Sr. | 53/555 X |
| 3,846,569 | 11/1974 | Kaplan | 53/555 X |
| 4,068,448 | 1/1978 | Mudeen | 53/131 |
| 4,215,524 | 8/1980 | Saylor | 53/555 X |

*Primary Examiner*—John Sipos

*Attorney, Agent, or Firm*—Baldwin, Egan, Walling & Fetzer

[57] ABSTRACT

A portable packaging machine for making a continuous ribbon of interconnected packets with each packet containing one or more pills or capsules. The machine has a unique single frame structure whereby the machine weighs less than fifty pounds to facilitate shipping, particularly in those instances where a fifty pound maximum is a factor. The frame is of open construction to provide increased air circulation. A message is imprinted on each packet by means of a stencil having a special stamp pad and ink to provide a clear imprinted impression after an unusually high number of impressions.

1 Claim, 14 Drawing Figures

PACKAGING MACHINE

This is a continuation of application Ser. No. 242,365 filed Mar. 10, 1981, now abandoned.

BACKGROUND OF THE INVENTION

This invention relates to packaging machines and more particularly to a compact, portable desk-top packaging machine for making a continuous ribbon of interconnected packets with each packet containing one or more pills or capsules.

Prior pill and capsule packaging machines contain numerous shortcomings such as excessive weight, overheating, poor imprinting of the message on each packet, etc. Excessive weight is a particularly burdensome problem as some shipping companies will not ship an item weighing over fifty pounds. Excessive heat from the packet heat-sealing means and from the electric motor often results in deterioration of the pills or capsules. Prior imprinting means using wet ink and stencil has proved to be most ineffective as the imprinted message becomes dull, light, or smeared after only a very few packet imprints.

Therefore, it is an object of the invention to provide a portable, compact, desk-top pill and capsule packaging machine weighing less than fifty pounds.

A further object of the invention is to provide a machine of the above type having an open frame construction effecting substantially improved air circulation to reduce heat build-up.

A further object of the invention is to provide a machine of the above type that provides a clear, permanent, imprint on pharmaceutical paper after an unusually high number of impressions where wet ink printing is involved.

A further object of the invention is to provide a machine of the above type that is simple in construction, inexpensive to manufacture, and highly effective in operation.

BRIEF DESCRIPTION OF THE INVENTION

Briefly, the foregoing objects are accomplished by the provision of a compact portable packaging machine for making a continuous ribbon of interconnected packets with each packet containing one or more articles (i.e. pills, tablets, capsules) to be dispensed. The machine includes a unitary one-piece frame, a first roll of a strip of flexible heat-sealable packaging material rotatably mounted on one end of the frame, and a second coacting roll of a strip of flexible heat-sealable packaging material rotatably mounted on the other end of the frame opposite the first roll. Guide means are provided on the frame for guiding the two strips of packaging material from the rolls together through the frame in parallel, longitudinal, heat-sealable-to-heat-sealable, surface-to-surface registry.

Pull-down means in the form of two pairs of spaced, coacting pull-down rolls are provided for pulling the two strips of packaging material through the guide means in predetermined sequence. A turntable or disc is operatively mounted on the frame for feeding, in predetermined sequence, one or more pills or capsules between the two coacting strips of packaging material just before they come together in parallel longitudinal surface-to-surface registry. Heat-sealing means is operatively disposed on the frame for heat sealing the margins on the two coacting strips of packaging material together with the pills or capsules therebetween to form a hermetic cavity containing the pills. Perforating means in the form of a serrated knife blade is disposed on the heat sealing means for forming perforations on each transverse side of the packet cavity. Printing means is operatively mounted on the frame for imprinting a predetermined message on one of the strips before the two strips come together in parallel, longitudinal, surface-to-surface registry. Drive means in the form of an electric motor and related gear devices is provided for coactingly actuating the pull-down rolls, the turntable, the heat-seal means, the perforating means, and the printing means in predetermined coacting operative relationship to form a continuous ribbon of interconnected hermetic packets containing one or more articles to be dispensed.

The frame includes spaced front and rear walls connected by a plurality of intermediate transverse ribs to form a light-weight single unitary one-piece frame of open construction allowing maximum air circulation with all of the elements of the machine being mounted on the frame, such construction providing a machine weighing less than fifty pounds.

The heat-sealing means including a sealing back-up jaw block mounted on the frame at a point where the strips initially come together in surface-to-surface registry, such back-up jaw block having a heater element therein. A sealing jaw is reciprocably mounted on the frame opposite the back-up jaw block for movement to and from the back-up jaw block and configured for marginal contact therewith. The sealing jaw has a heater element therein. The heater elements provide predetermined temperatures in the back-up jaw block and in the sealing jaw, whereby when the sealing jaw is reciprocated against the back-up jaw block, with the surface-to-surface disposed strips therebetween, such strips are heat-sealed together around their margins.

The turntable includes a flat horizontal indexing table secured to the top of the frame. The indexing table has a vertical open-ended chute emptying at a point between the strips just before they come together in surface-to-surface registry. A turntable disc is rotatably mounted on the indexing table for preselective circumferential rotation thereon, such disc having a plurality of spaced apertures formed adjacent to and around its circumferential periphery with each aperture registering with the chute as the disc is selectively rotated, whereby article(s) (such as pills or capsules) may be placed in the apertures (and thus rest on the indexing table) and thereby fall down the chute selectively one by one as the disc is preselectively rotated, and thence fall between the strips at which point the strips become heat-sealed around their margins by the heat-sealing means, to thus form a heat-sealed, air-tight packet with the pill or capsule therein. The indexing table has cooling fins formed on its undersurface to dissipate heat, thereby preventing over-heating of the pills and/or capsules placed on the turntable disc. For certain capsules, the disc is selectively rotated (and the disc apertures are selectively prepositioned) whereby each of the disc apertures comes into registry with the chute at a point approximately sixty-two one thousandths of an inch in advance of the radial centerline of the chute to accommodate capsules of certain configurations in passing effectively down the chute.

The printing means for imprinting a predetermined message on one of the strips of packaging material is a cam-operated stencil, and the drive means acts in coacting operative relationship with the one strip to cause such one strip to be stationary when the stencil is imprinting a message on the strip. The stencil includes an inked stamp pad formed of very tight woven fibers to retain a high solids type of high viscosity ink therein and to provide a super-absorbent pad. The stamp pad contains ink of very high viscosity to effect maximum ink retention in the ink pad, such ink being forced into the ink pad by means of pressure and vacuum. The ink may be a graphite added type ink to effect a more pronounced printed impression and maximum retention in the ink pad.

The drive means includes an idler sprocket having a one-way clutch bearing to forestall drive reversal and resultant parts jamming.

The strips may be formed of clear thermoplastic material enabling visual inspection of the packaged article(s).

Other objects and advantages of the invention will be apparent from the following description taken in conjunction with the drawings wherein:

FIG. 14 is a wiring diagram of the machine shown in FIG. 1.

In the drawings, like numbers and letters are used to identify like and similar parts throughout the several views.

DESCRIPTION OF THE PREFERRED EMBODIMENTS

Figure 9:
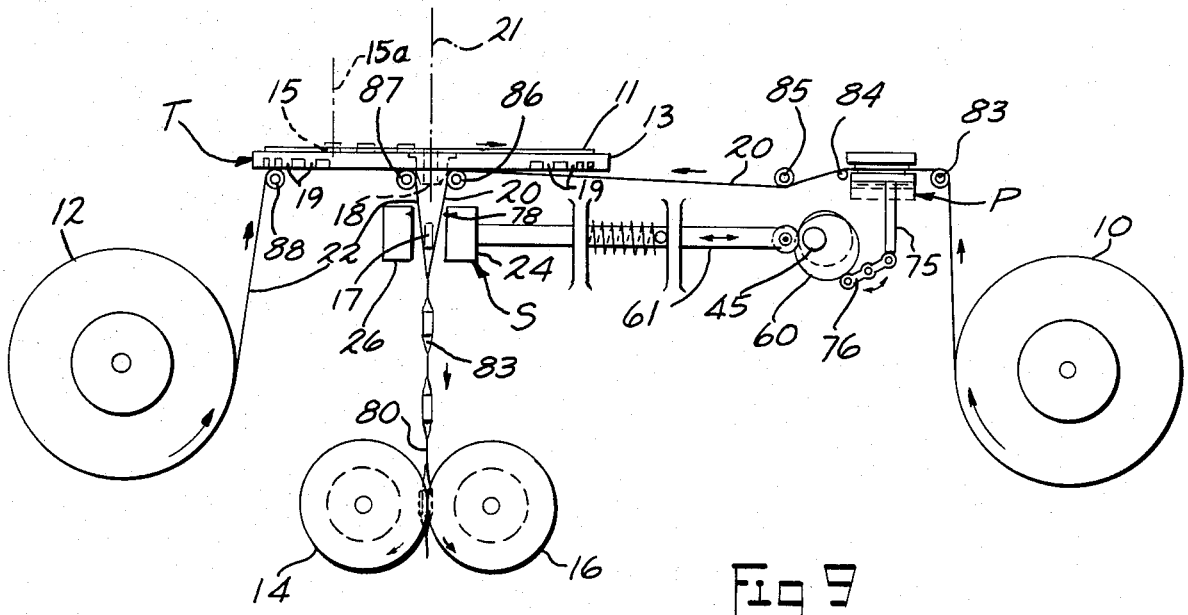
FIG. 9 is a schematic view showing operation of the basic elements of the machine of FIG. 1.
Figure 10:
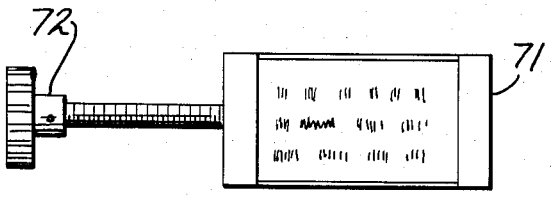
FIG. 10 is a top plan view of the stencil device contained on the machine of FIG. 1.
Figure 11:
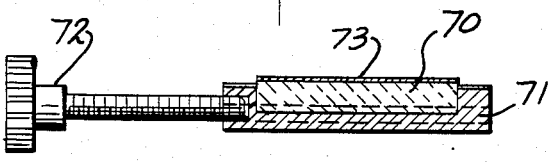
FIG. 11 is a side elevational sectional view of the stencil device shown in FIG. 10.
Figure 12:
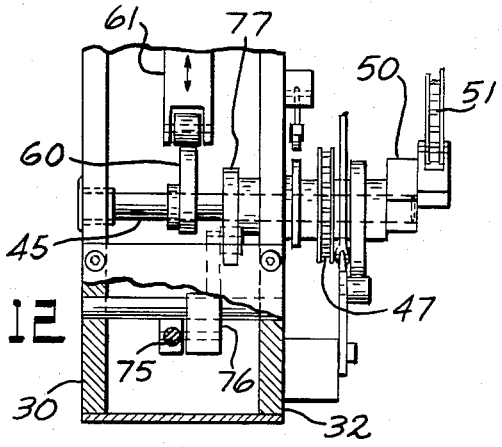
FIG. 12 is an enlarged top plan view, partly in section, of the right portion of the drive mechanism shown in FIG. 7, and showing certain parts thereof in phantom view.
Figure 13:
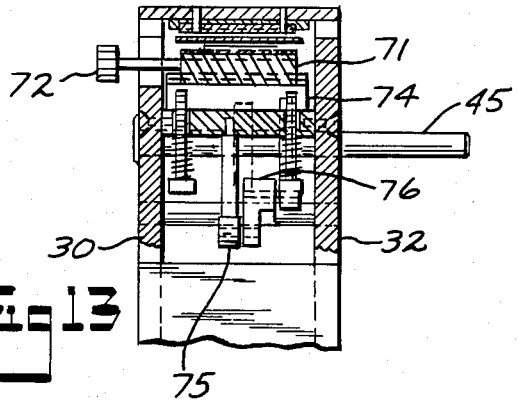
FIG. 13 is an end elevational sectional view of the mechanism shown in FIG. 12.
Figure 4:
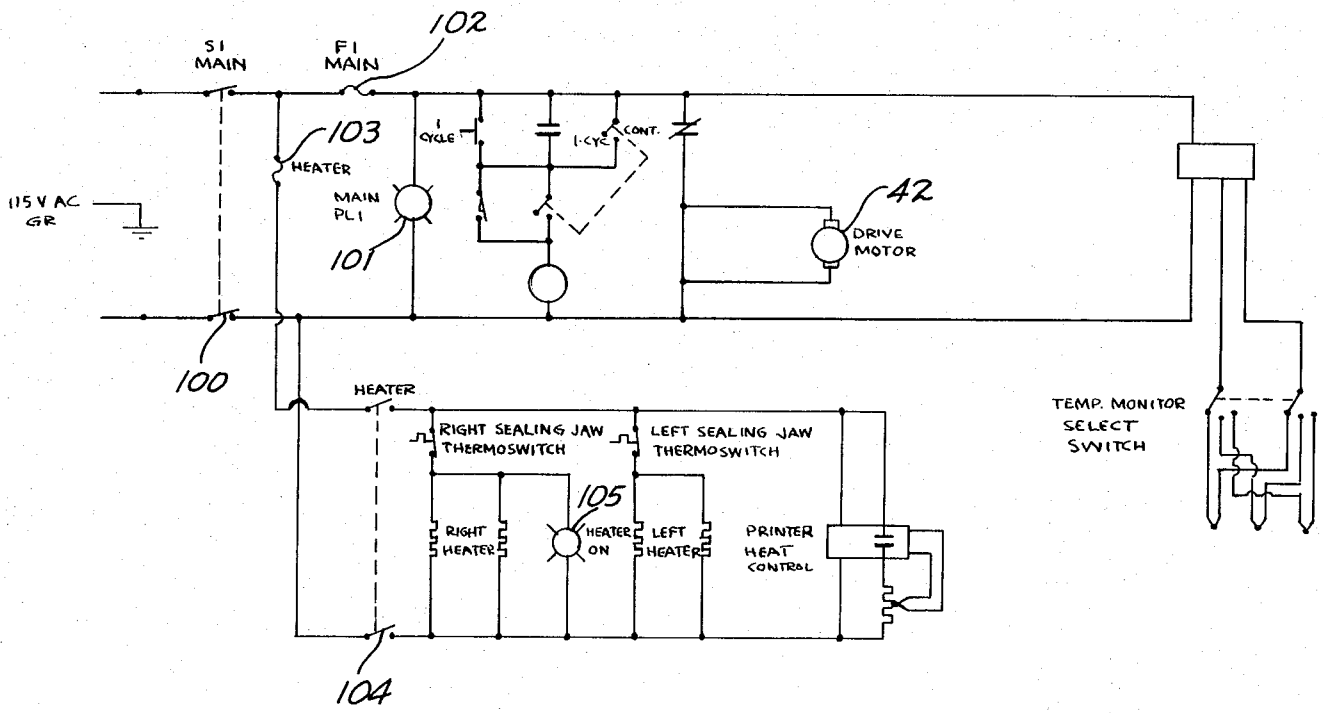

Reference is first made to FIG. 9, which shows the basic elements of the machine of the invention in schematic form. The basic elements of the machine are the feed rolls 10 and 12 of strip packaging material, the indexing turntable or turntable means T (including a circular rotatable disc 11), the printer means P, the heat-sealing means S, and the coacting pull-down rolls 14 and 16.

Each of the coacting pull-down rolls 14, 16, comprises a pair of parallel spaced wheels, with the inner wheel of each pair not being shown.

In operation, pills, tablets or capsules 17 to be packaged are initially placed in peripheral apertures in the disc 11 and, as the disc is selectively rotated, the pills drop down the chute 18 and thence in between the moving incoming strips of packaging material 20 and 22 from the rolls 10 and 12, respectively, such strips 20, 22 being pulled through the machine by the coacting pull-down rolls 14 and 16. After the tablet or pill 17 falls down between the opposed coacting strips 20 and 22, the heated sealing jaw 24 is moved against the sealing jaw back-up block 26 to heat-seal the tablet 17 between the strips 20 and 22, thereby forming a continuous ribbon of interconnected packets. The printer P has a novel stencil for imprinting a message on the strip 20 as will be hereinafter explained in detail.

Referring now to FIGS. 1–5, a feature of the invention is the main frame F which includes spaced front and rear walls 30 and 32 connected by a plurality of transverse ribs 33, 34, 35, 36, 37, 38 and 39. Thus, there is provided a single, unitary, one-piece frame of open construction allowing free air circulation for maximum cooling. All the elements of the machine are mounted on the frame, such construction providing a machine weighing less than fifty pounds.

Figure 7:
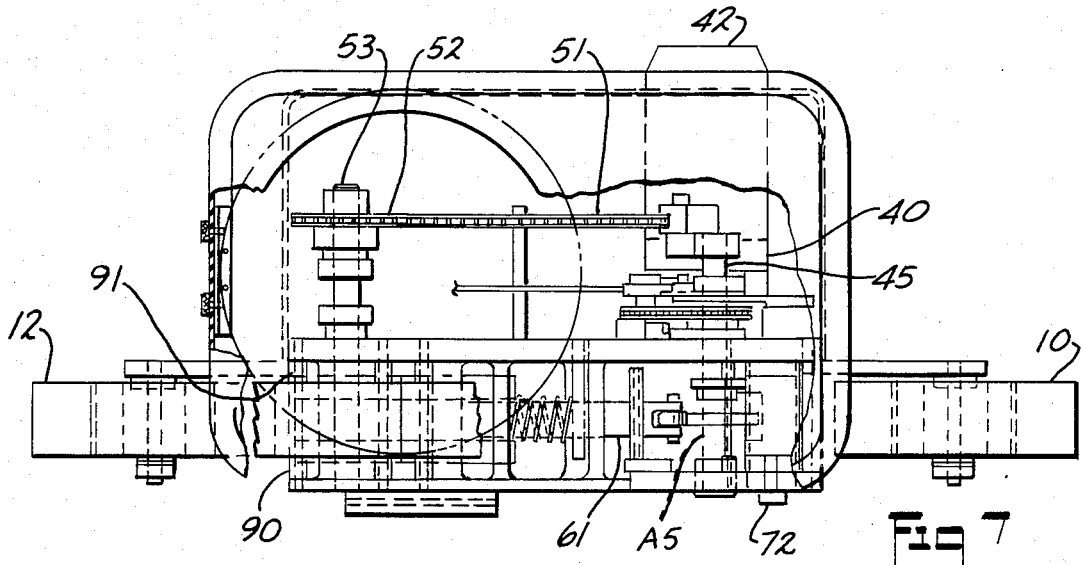
FIG. 7 is a top plan view of the machine shown in FIG. 6, and showing certain parts thereof in phantom view.
Figure 6:
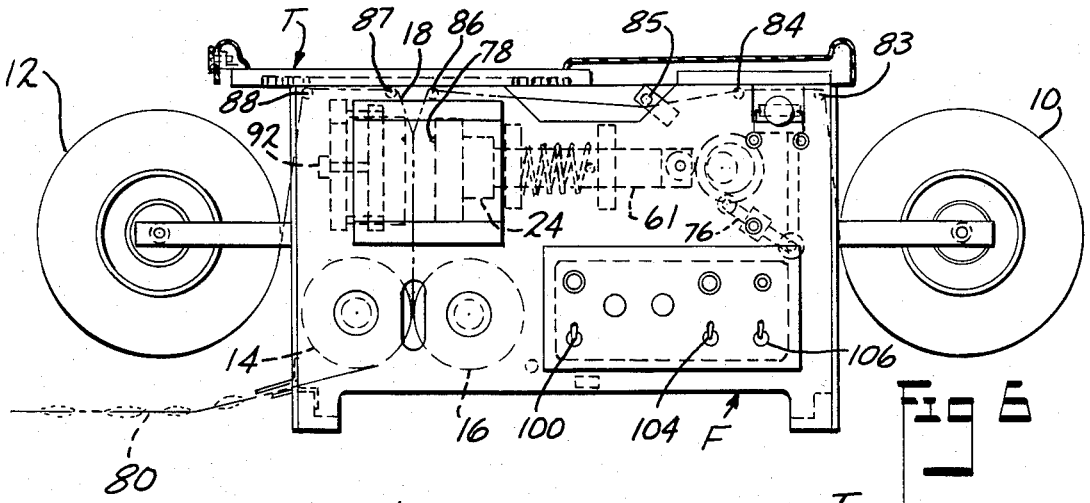
FIG. 6 is a front elevational view of the machine shown in FIG. 1, and showing certain parts thereof in phantom view.
Figure 8:
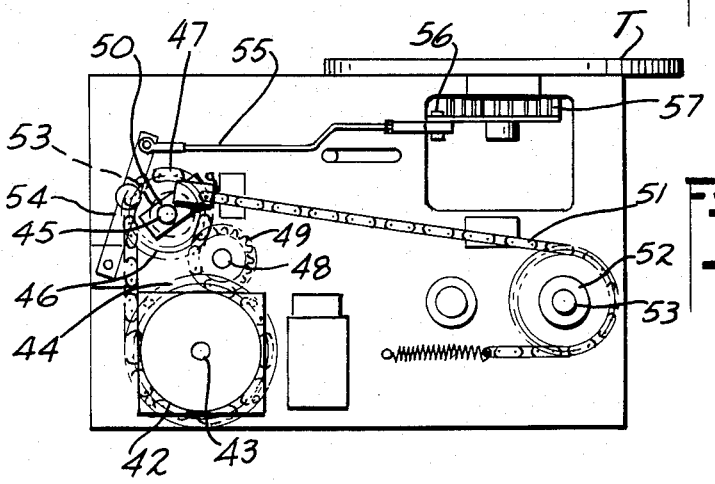
FIG. 8 is a rear elevational view of the machine shown in FIG. 6.

The packaging machine drive means includes an electric motor 42 and associated gearing now to be described and best shown in FIGS. 6, 7 and 8. Connected to the motor shaft 43 is a sprocket wheel 44. Disposed above the motor 42 is a rotatable secondary shaft 45 having the sprocket wheel 46 thereon. The sprocket wheels 44 and 46 are operatively connected by the sprocket chain 47. An idler shaft 48 has a sprocket 49 thereon which is also linked to the chain 47. With this structure, the motor thus drives the shafts 45 and 48.

The shaft 45 has a lever 50 which is rotatably connected to the sprocket chain 51, which, in turn, is geared to the sprocket 52 on the rotatable shaft 53. The shaft 53 drives the coacting pull-down rolls 14 and 16. Such structure is a lost motion type of gearing whereby the shaft 53 is turned intermittently, such that the strips 20 and 22 are advanced intermittently in a predetermined manner.

The shaft 45 has cam 53 thereon which acts against the lever 54 (which is rotatably secured at its lower end) which in turn pulls the rod 55 to the left (FIG. 8). The right end of the rod 55 is secured to a gear advancing mechanism 56 which advances the turntable gear 57 intermittently when the cam 53 pulls the lever 54 and rod 55 to the left. This structure rotates the turntable disc 11 (FIG. 9) in intermittent steps in a predetermined manner.

The sealing jaw 25 (FIG. 9) is reciprocated against the back-up block 26 by means of the cam 60 which is secured to the shaft 45. Specifically, the cam 60 acts against the sealing jaw rod 61 which pushes the jaw 24 against the block 26 to actuate the sealing means S.

Another feature of the invention is the cam operated printer means P, best shown in FIGS. 9–13. The printer P includes an ink pad 70 mounted in a pad frame 71 having a handle 72. Disposed on the ink pad 70 is a stencil paper 73 with a typed message imprinted thereon. The pad frame 71 slides onto and is detachably secured to the vertically reciprocable plate 74. The plate 74 is attached to the rod 75, which is hinged to the lever 76, such lever 76 being acted on by the cam 77 on the shaft 45. This construction provides a cam-operated printing means P.

A horizontally disposed serrated knife blade 78 (FIGS. 6 and 9) is secured to the sealing jaw 24 which functions to cut serrations or perforations on each horizontal side of each packet for ease in manually tearing the same from the ribbon 80 of interconnected packets.

Thus, the invention provides a compact, portable, packaging machine for making a continuous ribbon 80 of interconnected packets with each packet containing one or more articles 17 to be dispensed including a unitary one-piece frame F, a first roll 10 of a strip 20 of flexible packaging material rotatably mounted on one end of the frame, and a second coacting roll 12 of a strip 22 of flexible packaging material rotatably mounted on the other end of the frame opposite the first roll. Guide means 83, 84, 85, 86, 87 and 88 are provided on the frame F for guiding the two strips of packaging materials from the rolls 10 and 12 together through the frame in parallel longitudinal surface-to-surface registray. Pull-down means 14, 16 are provided for pulling the two strips 20, 22 of packaging material through the guide means in predetermined sequence. Turntable means T are operatively mounted on the frame F for feeding, in predetermined sequence, one or more articles 17 between the two coacting strips 20, 22 of packaging material just before they come together in parallel longitudinal surface-to-surface registry. Heat-sealing means S are operatively disposed on the frame F for heat-sealing the opposed margins of the two coacting strips 20, 22 of packaging material together with the article(s) 17 therebetween to form an air-tight cavity containing the article(s). A perforating means 78 is disposed on the heat sealing means S for forming linear transverse perforations 81 (FIG. 1) on each transverse side of each cavity 83 (FIG. 9). Printing means P is operatively mounted on the frame F for imprinting a predetermined message on one of the strips (20) before the two strips 20, 22 come together in parallel longitudinal surface-to-surface registry. Drive means in the form of an electric motor 42 and related gearing are provided for coactingly actuating the pull-down means 14, 16, the turntable means T, the heat seal means S, the perforating means 78, and the printing means P in predetermined coacting operative relationship to form a continuous ribbon 80 (FIG. 1) of interconnected air-tight packets containing one or more articles 17 to be dispensed.

The guide means for the strips 20, 22 is a plurality of prepositioned rods 83, 84, 85, 86, 87 and 88, with certain of such rods having thereon adjustable spaced sleeves 90, 91 (FIG. 7) that are longitudinally adjustable on the rods to guide the strips 20, 22 therebetween.

The heat-sealing means S includes a sealing back-up jaw block 26 mounted on the frame F at a point where the strips 20, 22 initially come together in surface-to-surface registry. The back-up jaw block 26 has an electrical heater element 92 (FIG. 6) therein. The heat-sealing means also includes a sealing jaw 24 reciprocably mounted on the frame F opposite the back-up jaw block 26 for reciprocable movement to and from the back-up jaw block 26 and configured for marginal contact therewith. The sealing jaw 24 has a heater element 93 (FIG. 1) therein. The heater elements 92, 93 effect predetermined temperatures in the back-up jaw block 26 and in the sealing jaw 24, whereby when the sealing jaw 24 is reciprocated against the back-up jaw block 26, with the surface-to-surface disposed thermoplastic strips 20, 22, therebetween, such strips are hermetically heat-sealed together around their margins.

The turntable means T includes a flat horizontal indexing table 13 secured to the top of the frame F. The table 13 has a vertical open-ended chute 18 emptying at a point between the strips 20, 22 just before they come together in surface-to-surface registry. A turntable disc 11 is rotatably mounted on the table 13 for preselective circumferential rotation thereon.

The disc 11 has a plurality of spaced apertures 15 formed adjacent to and around its circumferential periphery with each aperture 15 registering with the chute 18 as the disc 11 is selectively rotated, whereby article(s) 17 may be placed in the apertures 15 and thereby fall down the chute 18, one by one, as the disc 11 is preselectively rotated, and thence fall between the strips 20, 22 and become heat-sealed therebetween by heat-sealing means S.

Preferably, the chute 18 is anodized or hard-coated aluminum.

The indexing table 13 has cooling fins 19 formed on its undersurface to dissipate heat, thereby preventing overheating of the article(s) 17. Also, without such fins 19 to dissipate rising heat from the heater elements 92, 93, the resultant heat build-up would be detrimental to maintaining operating speeds.

With certain types of capsules (17), it is preferred that each of the apertures 15 comes into registry with the chute 18 at a point approximately sixty-two one thousandths of an inch in advance of the radial centerline 21 of the chute to accommodate such capsules with certain configurations in passing effectively down the chute. More specifically and referring to FIG. 9, as the disc 11 is intermittently rotated and stopped to selectively position each aperture 15, in turn, over the chute 18 to thus allow each pill disposed in each aperture 15 to drop down the chute 18, it is preferred that as each pill from each aperture 15 comes into complete registry or is positioned completely over the chute 18, such registry is most efficient when complete registration occurs at a point approximately sixty-two one thousandths of an inch in advance of the chute radial centerline 21 for the most effective (jam-free) transfer of each pill from each aperture 15 down the chute 18. It is to be noted that each of the disc apertures 15 is slightly smaller than the chute 18.

It is to be noted that the printing means P for imprinting a predetermined message on the strip 20 is a cam-operated stencil 70, 71, 72, 73, and the drive means acting in coacting operative relationship with the strip 20, causes the strip 20 to be stationary when the stencil is imprinting a message on the strip.

Another feature of the invention is the stamp pad 70. Specifically, the stencil includes the inked stamp pad 70 which is formed of very tight woven fibers (to retain ink therein) and thus provides a dense but porous pad. Also, the stamp pad contains ink of very high viscosity to effect maximum ink retention in the ink pad. Additionally, the ink is forced into the ink pad by means of vacuum and pressure.

It is preferred that the drive means includes an idler sprocket 49 having a one-way clutch bearing 40 to forestall drive reversal and resultant parts jamming.

One of the strips 20, 22, may be portionally formed of clear carrier material with a thermoplastic coating to obtain sealability plus visual inspection of the package contents. If a light-proof package (packet) is required, then both strips should be opaque.

Figure 1:
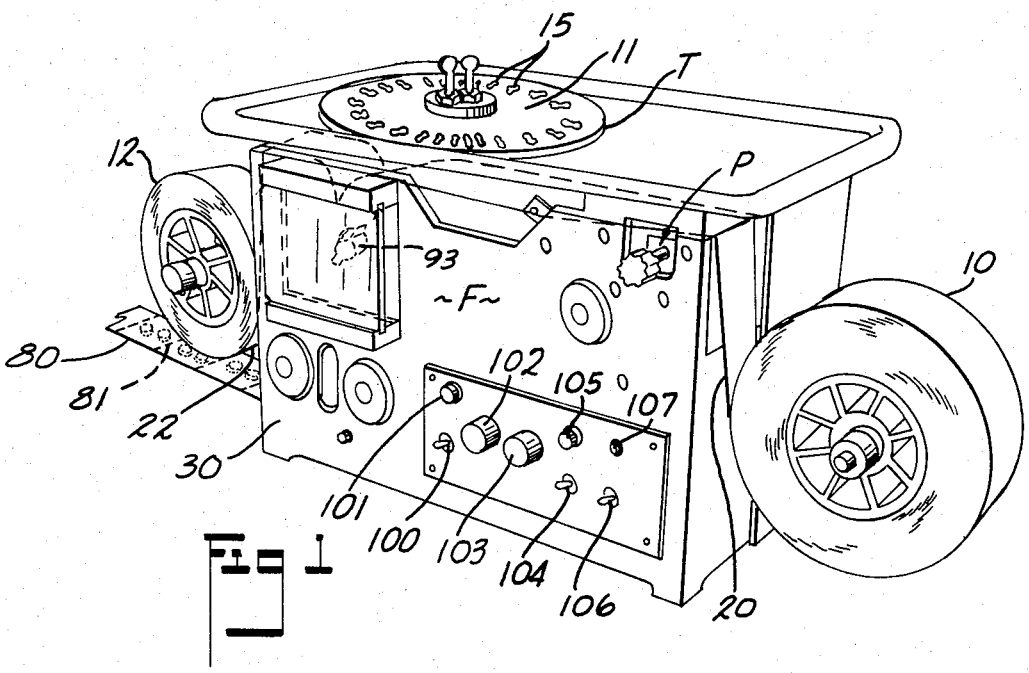
FIG. 1 is a perspective view of a pill and capsule packaging machine constructed in accordance with the invention.
Figure 3:
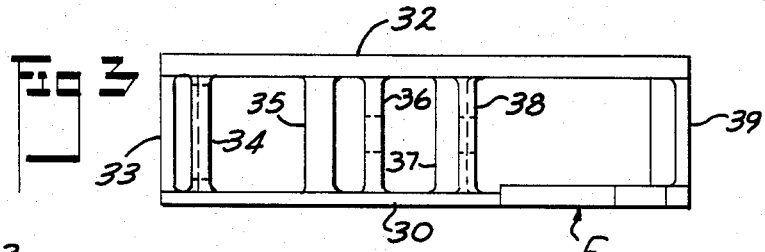
FIG. 3 is a top plan view of frame shown in FIG. 2.
Figure 5:
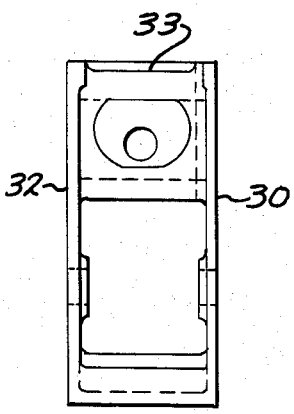
FIG. 5 is a left end elevational view of the machine shown in FIG. 2.
Figure 2:
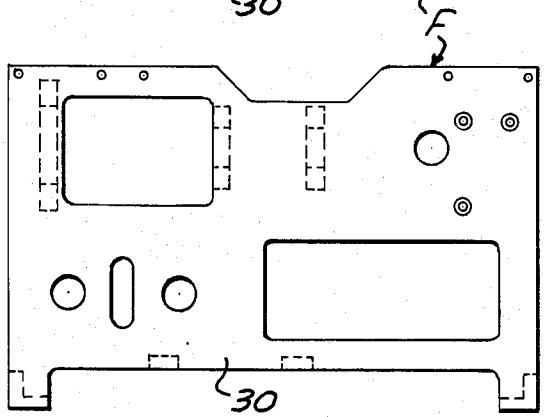
FIG. 2 is a front elevational view of the main frame of the machine shown in FIG. 1.
Figure 4:
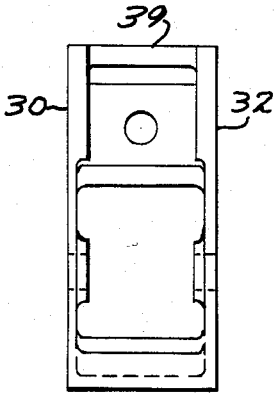
FIG. 4 is a right end elevational view of the frame shown in FIG. 2.

The controls for the packaging machine are best shown in FIGS. 1 and 14. Specifically, there is provided a main on-off switch 100, a main power-on indicator lamp 101, a main fuse 102, a heater fuse 103, a heater on-off power switch 104, a heater-on lamp 105, a continuous run on-off switch 106, and a one cycle or jog button 107.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

What is claimed is:

1. A compact manually portable packaging machine weighing less than fifty pounds for making a continuous ribbon of interconnected packets with each packet containing one or more articles to be dispensed comprising; a unitary one-piece open type frame having spaced front and rear walls connected by a minimal plurality of intermediate transverse ribs to form a lightweight single unitary compact small one-piece frame of open construction allowing maximum air circulation with all of the elements of the machine being mounted on the frame; a first roll of a strip of flexible packaging material rotatably mounted on one end of the frame; a second coacting roll of a strip of flexible packaging material rotatably mounted on the other end of the frame opposite said first roll; coacting guide means on said frame for guiding the two strips of packaging material from said rolls together through said frame in parallel longitudinal surface-to-surface registry, said guide means including a plurality of prepositioned rods, with certain of said rods having thereon coacting spaced sleeves that are longitudinally adjustable on the rods to guide the strips therebetween; heat sealing means operatively disposed on the frame for heat sealing all opposed margins of the two coacting strips of packaging material together with the article(s) therebetween to form an air-tight cavity containing said article(s), coacting pull-down means for pulling said two strips of packaging material through said guide means in predetermined sequence, said pull-down means including a first pair of parallel spaced wheels rotatably mounted on the frame at a preselected point below said heat-sealing means, a second pair of parallel spaced wheels rotatably mounted on the frame opposite said first pair of wheels in coacting operative relation therewith, whereby said first and second pair of wheels coact to pull down on the heat-sealed longitudinal margins of the surface-to-surface disposed strips to pull the same through the machine; turntable means operatively mounted on the frame for feeding in predetermined sequence one or more articles between said two coacting strips of packaging material just before they come together in parallel longitudinal surface-to-surface registry, said turntable means including a flat planar horizontal table secured to the top of the frame, said table having a vertical open-ended chute emptying at a point between said strips just before they come together in surface-to-surface registry, a horizontal turntable disc rotatably mounted on said table for preselective circumferential rotation thereon, said disc having a plurality of spaced disc apertures formed adjacent to and around its circumferential periphery with each aperture registering with the chute as the disc is selectively rotated, whereby article(s) may be placed in said apertures and thereby fall down said chute one by one as the disc is preselectively rotated and thence fall between said strips and become heat-sealed therebetween by said heat-sealing means; said apertures of said disc being smaller than the chute, said heat-sealing means including a sealing back-up jaw block mounted on the frame at a point where said strips initially come together in surface-to-surface registry, said back-up jaw block having a heater element therein, a sealing jaw reciprocably mounted on the frame opposite said back-up jaw block for movement to and from the back-up jaw block and configured for preselected marginal contact therewith, said sealing jaw having a coacting heater element therein, said heater elements effecting predetermined temperatures in the back-up jaw block and in the sealing jaw, whereby when the sealing jaw is reciprocated against the back-up jaw block with the surface-to-surface disposed strips therebetween such strips are heat-sealed together around their margins; perforating means disposed on said heat-sealing means for forming transverse perforations on each transverse side of the cavity, said perforating means including a horizontally disposed serrated linear knife blade mounted adjacent the upper horizontal edge of said reciprocable sealing jaw, whereby when said sealing jaw is reciprocated against said back-up jaw block said blade contacts said back-up jaw block with the surface-to-surface disposed strips therebetween thereby cutting a linear row of serrations transversely across said strips; printing means in the form of a cam-operated stencil operatively mounted on the frame for imprinting a predetermined message on one of said strips before the two strips come together in parallel longitudinal surface-to-surface registry, said stencil including an inked stamp pad formed of very tight woven fibers effecting a dense porous ink pad to retain ink therein, said stamp pad containing a graphite added type ink of very high viscosity to effect maximum ink retention in the ink pad; and drive means for coactingly actuating said pull-down means, said turntable means, said heat seal means, said perforating means, and said printing means in predetermined coacting operative relationship to form a continuous ribbon of interconnected air-tight packets containing one or more articles to be dispensed, said drive means acting in coacting operative relationship with said one strip to cause said one strip to be stationary when said stencil is imprinting a message on such one strip, said chute being formed of anodized, hard-coated aluminum, the turntable disc being selectively rotated whereby of each of said disc apertures comes into complete registry with said chute at a point approximately sixty-two one thousandths of an inch in advance of the radial centerline of the chute to accommodate article(s) of certain configurations in passing effectively down the chute, said high viscosity ink being initially forced into the ink pad by means of vacuum and pressure, at least one of said strips being formed of clear thermoplastic material enabling visual inspection of the encased packaged article(s).

* * * * *